US009119523B2

(12) United States Patent
McDaniel et al.

(10) Patent No.: US 9,119,523 B2
(45) Date of Patent: Sep. 1, 2015

(54) DISHWASHER APPLIANCE WITH RACK ASSEMBLY PROJECTIONS

(75) Inventors: Aaron Matthew McDaniel, Louisville, KY (US); Darrell W. Shewmaker, Georgetown, IN (US); Ryan James Diener, Louisville, KY (US); William Nathan Garnett, Ekron, KY (US); Daniel J. Hart, Louisville, KY (US); Carl Joseph Rhodes, Jr., Lousiville, KY (US); Rebecca Ann Eakins, Lousiville, KY (US)

(73) Assignee: General Electric Company, Schenectady, NY (US)

( * ) Notice: Subject to any disclaimer, the term of this patent is extended or adjusted under 35 U.S.C. 154(b) by 651 days.

(21) Appl. No.: 13/539,933

(22) Filed: Jul. 2, 2012

(65) Prior Publication Data

US 2014/0000663 A1 Jan. 2, 2014

(51) Int. Cl.
*A47L 15/50* (2006.01)

(52) U.S. Cl.
CPC ..... *A47L 15/50* (2013.01); *A47L 15/502* (2013.01); *A47L 15/508* (2013.01)

(58) Field of Classification Search
None
See application file for complete search history.

(56) References Cited

U.S. PATENT DOCUMENTS

| | | | | |
|---|---|---|---|---|
| 4,834,125 | A * | 5/1989 | Insalaco | 134/201 |
| 7,694,844 | B2 | 4/2010 | Woo | |
| 2007/0039636 | A1 | 2/2007 | Egger et al. | |
| 2008/0302397 | A1 | 12/2008 | Buhlmeyer et al. | |

FOREIGN PATENT DOCUMENTS

| | | | |
|---|---|---|---|
| WO | WO 2005/037051 | A1 | 4/2005 |
| WO | WO 2006/010711 | A2 | 2/2006 |

* cited by examiner

*Primary Examiner* — Jason Ko
(74) *Attorney, Agent, or Firm* — Dority & Manning, P.A.

(57) ABSTRACT

A dishwasher appliance with a tub that defines a wash chamber is provided. A rack assembly is received within the wash chamber and includes a projection that extends from a front of the rack assembly. The projection is configured to engage a door of the dishwasher appliance and position the rack assembly in a retracted position when the door is in a closed position.

19 Claims, 8 Drawing Sheets

FIG. –1–

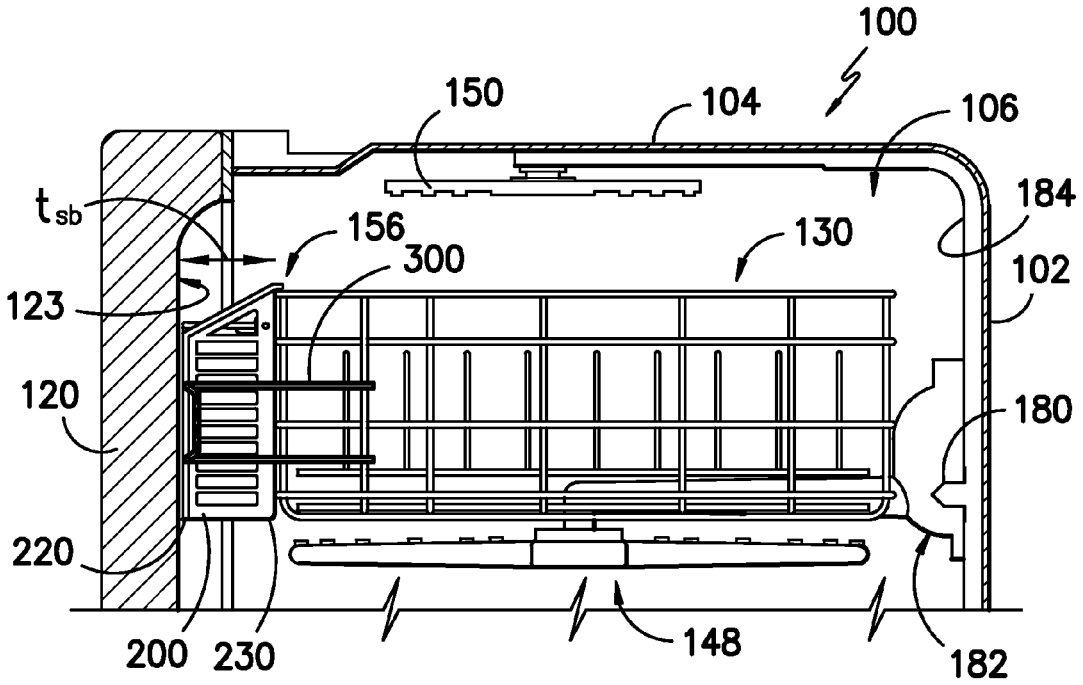
FIG. –6–
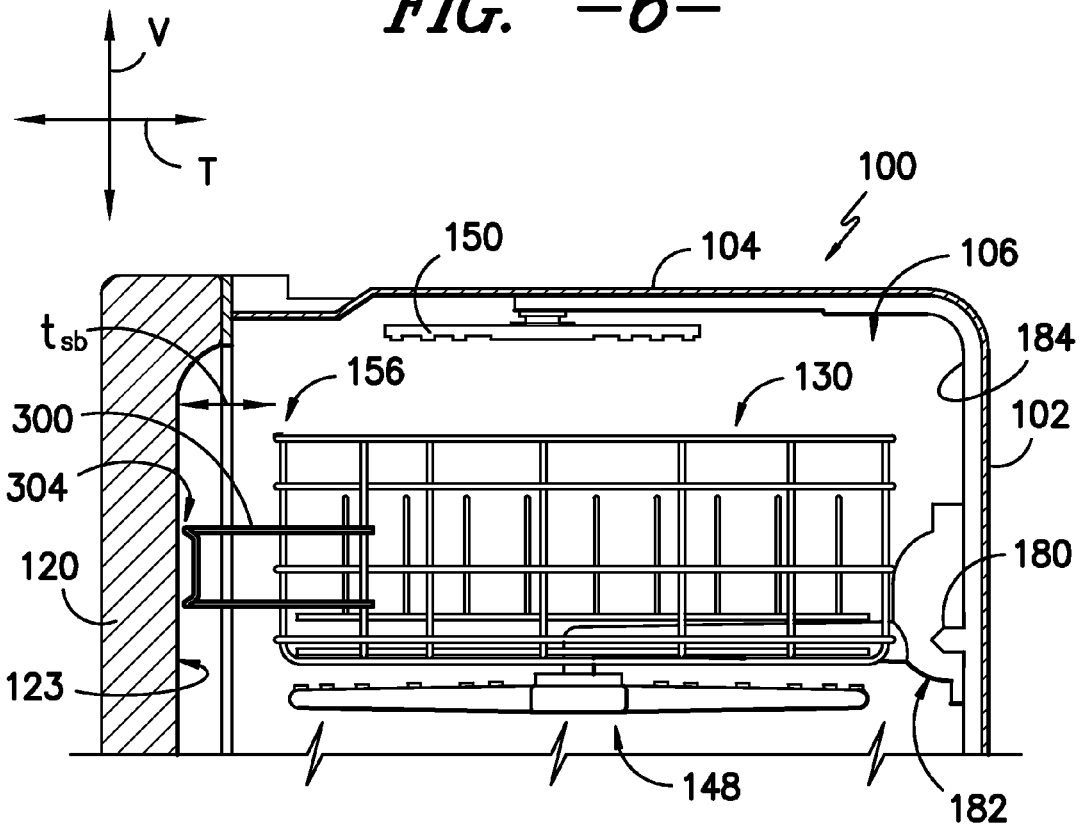
FIG. –7–

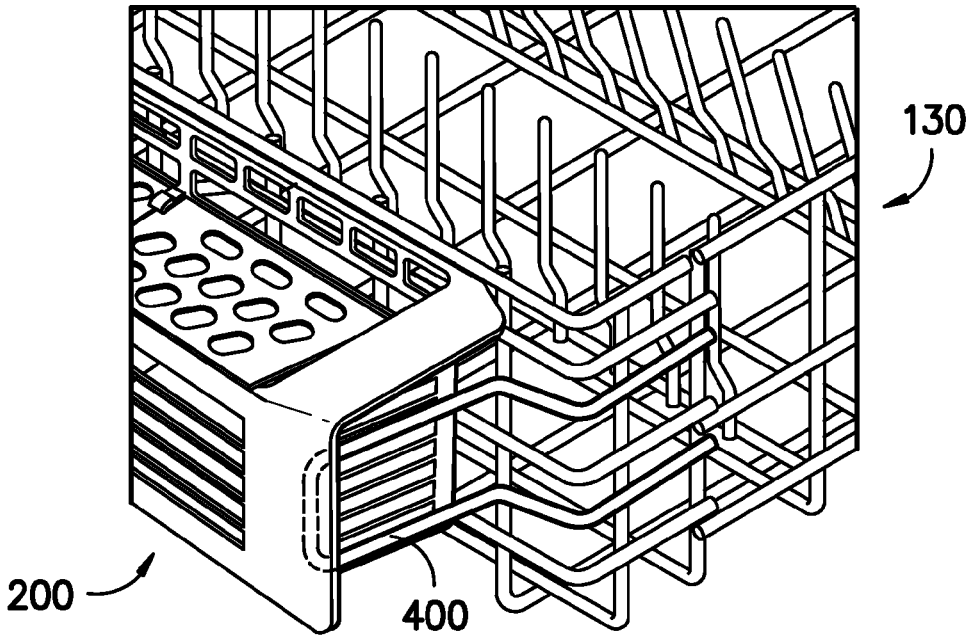
FIG. –8–
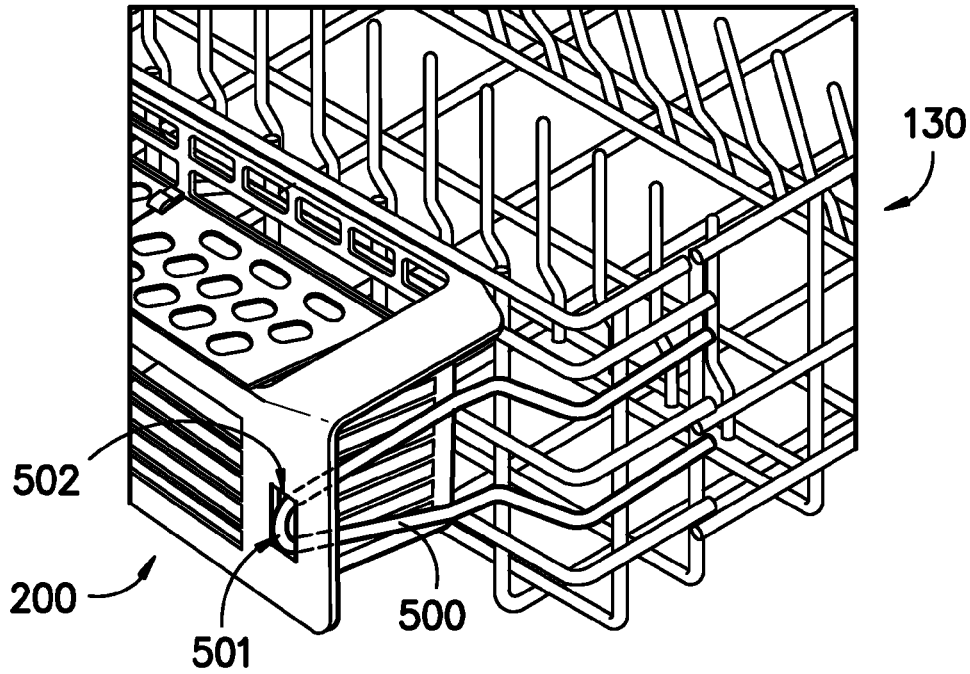
FIG. –9–

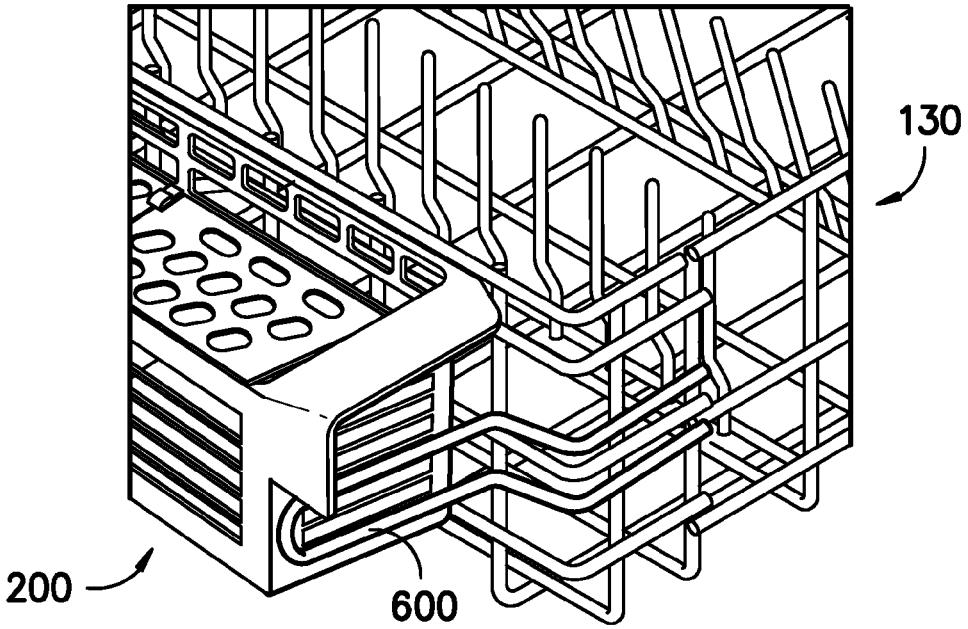
FIG. –10–
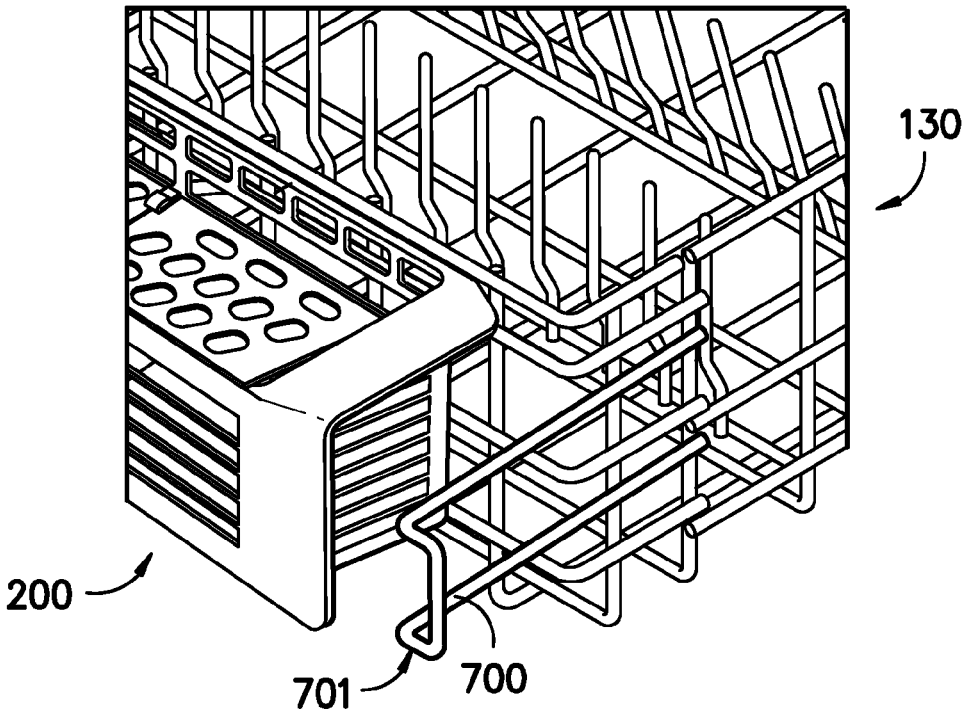
FIG. –11–

DISHWASHER APPLIANCE WITH RACK ASSEMBLY PROJECTIONS

FIELD OF THE INVENTION

The present subject matter relates generally to dishwasher appliances and, in particular, to dishwasher appliances with rack assemblies mounted within the dishwasher appliance.

BACKGROUND OF THE INVENTION

Dishwasher appliances generally include a tub that defines a wash chamber. Dishwasher appliances also generally include a rack assembly mounted within the wash chamber. The rack assembly is configured for receipt of articles for washing. For example, a user can slide the rack assembly out of the wash chamber and load plates, bowls, cups, or any suitable article or combination of articles into the rack assembly. After loading is complete, the user may slide the rack assembly back into the wash chamber.

In particular, the user can slide the rack assembly is to a retracted position. During operation of the dishwasher appliance, such a configuration for the rack assembly is preferable and may be required for certain dishwasher appliance components to function properly. For example, a door of the dishwasher appliance may not close properly if the rack assembly is not in the retracted position, and certain dishwasher appliances will not operate with an open door. Similarly, certain dishwasher appliances include a spray assembly mounted to the rack assembly. The spray assembly is normally configured such that the rack assembly must be positioned in the retracted position for the spray assembly to receive wash fluid during operation of the dishwasher appliance.

However, certain design factors and user behaviors can impede the rack assembly from being adjusted to the retracted position prior to starting the dishwasher appliance. For example, oversized articles within the rack assembly can catch or snag on other dishwasher appliance components. Also, certain dishwasher appliances include silverware baskets mounted to a front of the rack assembly. Removing the silverware basket can cause the rack assembly to not be positioned properly in the retracted position. In particular, the force of fluid entering the spray assembly during operation of the dishwasher appliance can push the rack assembly out of position if the silverware basket is removed. Also, pressing the door closed may not force the rack assembly into the retracted position if the silverware basket is removed.

Accordingly, a dishwasher appliance with features for assisting in positioning a rack assembly of the dishwasher appliance in a retracted position would be useful.

BRIEF DESCRIPTION OF THE INVENTION

The present subject matter provides a dishwasher appliance with a tub that defines a wash chamber. A rack assembly is received within the wash chamber and includes a projection that extends from a front of the rack assembly. The projection is configured to engage a door of the dishwasher appliance and position the rack assembly in a retracted position when the door is in a closed position. Aspects and advantages of the invention will be set forth in part in the following description, or may be apparent from the description, or may be learned through practice of the invention.

In a first exemplary embodiment, a dishwasher appliance is provided. The dishwasher appliance defines vertical, lateral, and transverse directions. The vertical, lateral, and transverse directions are mutually perpendicular. The dishwasher appliance includes a tub that defines a wash chamber. A door is positioned proximate the tub. The door permits selective access to the wash chamber of the tub. A rack assembly is positioned within the wash chamber and is configured for receipt of articles for cleaning The rack assembly having a front wall extending along the lateral direction. A silverware basket is removably mounted to the front wall of the rack assembly such that the silverware basket is disposed between the front wall of the rack assembly and the door along the transverse direction when the door is in a closed position. At least one projection is positioned at the front wall of the rack assembly. The projection extends away from the front wall of the rack assembly to about the door along the transverse direction when the door is in the closed position and the rack assembly is in a retracted position within the wash chamber of the tub.

In a second exemplary embodiment, a dishwasher appliance is provided. The dishwasher appliance defines vertical, lateral, and transverse directions. The vertical, lateral, and transverse directions are mutually perpendicular. The dishwasher appliance includes a tub that defines a wash chamber. A door is positioned proximate the tub and permits selective access to the wash chamber of the tub. A rack assembly is positioned within the wash chamber and is configured for receipt of articles for cleaning The rack assembly having a front wall extending along the lateral direction. A silverware basket is removably mounted to the front wall of the rack assembly such that the silverware basket is disposed between the front wall of the rack assembly and the door along the transverse direction when the door is in a closed position. The silverware basket has a thickness along the transverse direction. At least one projection is positioned at the front wall of the rack assembly and extends away from the front wall of the rack assembly along the transverse direction by about the thickness of the silverware basket.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIGS. 6 and 7 are side, partial cross-sectional views of the dishwasher appliance of FIG. 1 in which the silverware basket is mounted to the rack assembly in FIG. 6 and the silverware basket is removed from the rack assembly in FIG. 7.

FIGS. 8-11 illustrate various exemplary embodiments of a projection mounted to the rack assembly.

DETAILED DESCRIPTION

Figure 1:
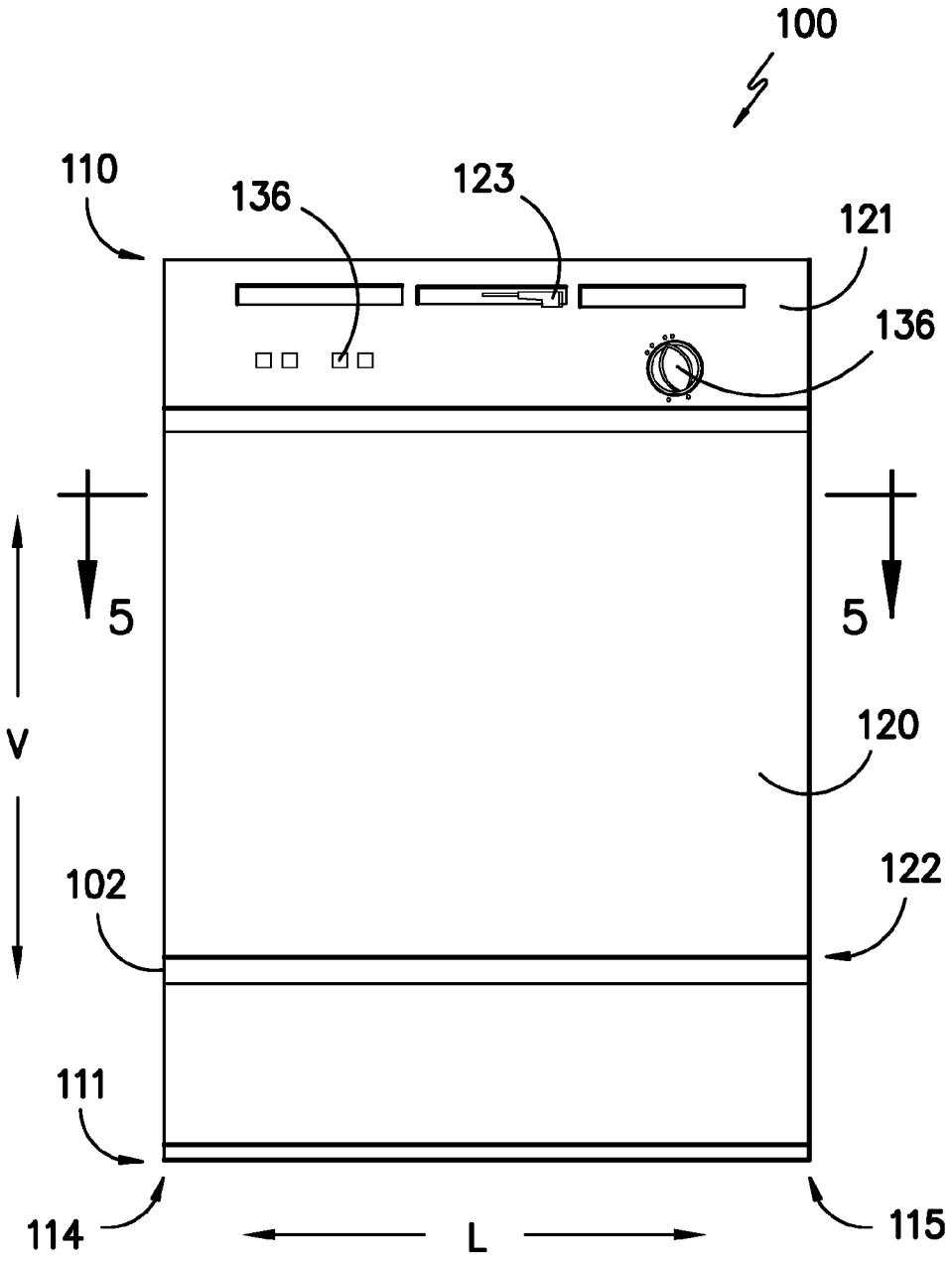
FIG. 1 provides a front view of a dishwasher appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
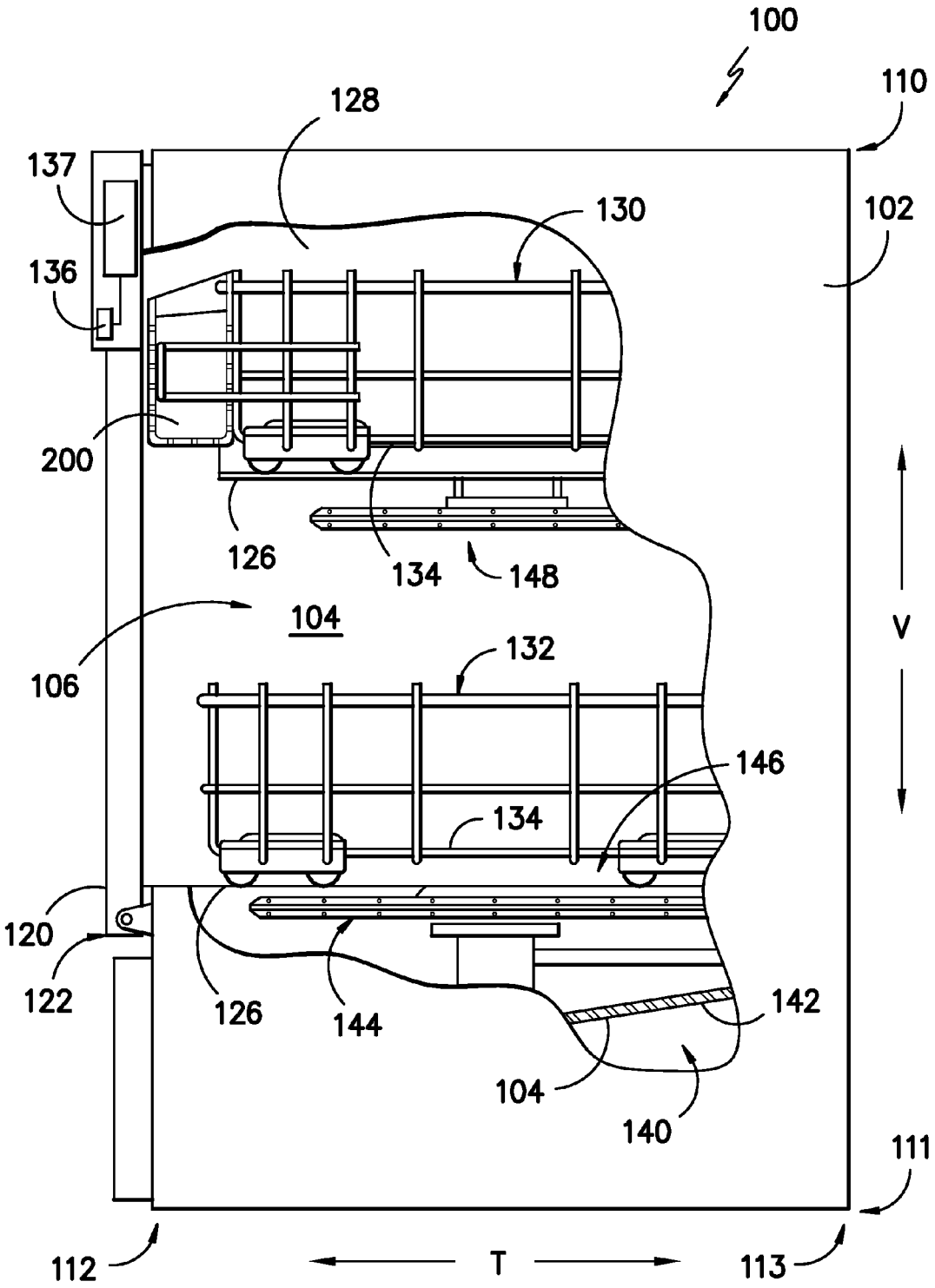
FIG. 2 provides a side view of the dishwasher appliance of FIG. 1 with portions of a cabinet of the dishwasher appliance removed to reveal an interior of the dishwasher appliance.

FIGS. 1 and 2 depict an exemplary dishwasher appliance 100 that may be configured in accordance with aspects of the present disclosure. The dishwasher appliance 100 includes a cabinet 102 having a tub 104 (FIG. 2) therein that defines a wash chamber 106 (FIG. 2). The tub 104 includes a door 120 hinged at its bottom 122 for movement between a normally closed configuration that is shown in FIGS. 1 and 2, wherein the wash chamber 106 is sealed shut, e.g., during dishwasher appliance 100 operation, and an open configuration, e.g., for loading and unloading of articles from the dishwasher appliance 100. A latch 123 (FIG. 1) is used to lock and unlock the door 120 for access to wash chamber 106.

Dishwasher appliance 100 defines a vertical direction V, a lateral direction L, and a transverse direction T. As may be seen in FIG. 1, dishwasher appliance 100 extends between a top 110 and a bottom 111 along the vertical direction V and also extend between a first side 114 and a second side 115 along the lateral direction L. As may be seen in FIG. 2, dishwasher appliance 100 also extends between a front 112 and a back 113 along the transverse direction T. Vertical direction V, lateral direction L, and transverse direction T are mutually perpendicular and form an orthogonal directional system.

As shown in FIG. 2, guide rails 126 are mounted on tub sidewalls 128 and accommodate upper and lower roller-equipped rack assemblies 130, 132. Each of the upper and lower racks 130, 132 is fabricated from lattice structures that include a plurality of elongated members 134. Each rack 130, 132 is adapted for movement between an extended loading position (not shown) in which the rack is substantially positioned outside the wash chamber 106, and a retracted position (shown in FIGS. 1 and 2) in which the rack is located inside the wash chamber 106.

A silverware basket 200 is removably mounted to upper rack assembly 130. However, silverware basket 200 may also be selectively attached to other portions of dishwasher appliance 100, e.g., lower rack assembly 132 or door 120. Silverware basket 200 is configured for receipt of silverware, utensils, and the like (e.g., spoons, forks, and/or knives) that are too small to be accommodated by the upper and lower rack assemblies 130, 132. Silverware basket 200 may be constructed of any suitable material, e.g., metal or plastic, and is discussed in greater detail below.

The dishwasher appliance 100 further includes a lower spray assembly 144 that is mounted within a lower region 146 of the wash chamber 106 and above a tub sump portion 142 so as to be positioned in relatively close proximity to lower rack 132. A mid-level spray assembly 148 is located in an upper region of the wash chamber 106 and may be located in close proximity to upper rack assembly 130. In particular, mid-level spray assembly 148 may be mounted to upper rack assembly 130 as discussed in greater detail below. Additionally, an upper spray assembly 149 (FIG. 6) may be located above the upper rack assembly 130.

The lower and mid-level spray assemblies 144, 148 and the upper spray assembly 149 are fed by a fluid circulation assembly (not shown) for circulating water and wash fluid in the tub 104. Portions of the fluid circulation assembly may be located in a machinery compartment 140 located below the bottom sump portion 142 of the tub 104, as generally recognized in the art. Each spray assembly includes an arrangement of discharge ports or orifices for directing washing liquid onto dishes or other articles located in the upper 149 and lower rack assemblies 130 and 132 and silverware basket 200. The arrangement of the discharge ports in at least the lower spray assembly 144 provides a rotational force by virtue of washing fluid flowing through the discharge ports. The resultant rotation of the lower spray assembly 144 provides coverage of dishes and other dishwasher contents with a washing spray.

The dishwasher appliance 100 is further equipped with a controller 137 to regulate operation of the dishwasher appliance 100. Controller 137 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one exemplary embodiment, the processor executes programming instructions stored in memory. The memory may be a separate component from the processor or may be included onboard within the processor.

The controller 137 may be positioned in a variety of locations throughout dishwasher appliance 100. In the illustrated exemplary embodiment, the controller 137 may be located within a control panel area 121 of door 120 as shown. In such an embodiment, input/output ("I/O") signals may be routed between the control system and various operational components of dishwasher appliance 100 along wiring harnesses that may be routed through the bottom 122 of door 120. Typically, the controller 137 includes a user interface panel 136 through which a user may select various operational features and modes and monitor progress of the dishwasher appliance 100. In one exemplary embodiment, the user interface panel 136 may represent a general purpose I/O ("GPIO") device or functional block. In one exemplary embodiment, the user interface panel 136 may include input components, such as one or more of a variety of electrical, mechanical or electro-mechanical input devices including rotary dials, push buttons, and touch pads. The user interface panel 136 may include a display component, such as a digital or analog display device designed to provide operational feedback to a user. The user interface 136 may be in communication with the controller 137 via one or more signal lines or shared communication busses.

It should be appreciated that the present subject matter is not limited to any particular style, model, or other configuration of dishwasher appliance and that the exemplary embodiment depicted in FIGS. 1 and 2 is for illustrative purposes only. For example, the present subject matter may be used in dishwasher appliances having other rack configurations.

Figure 3:
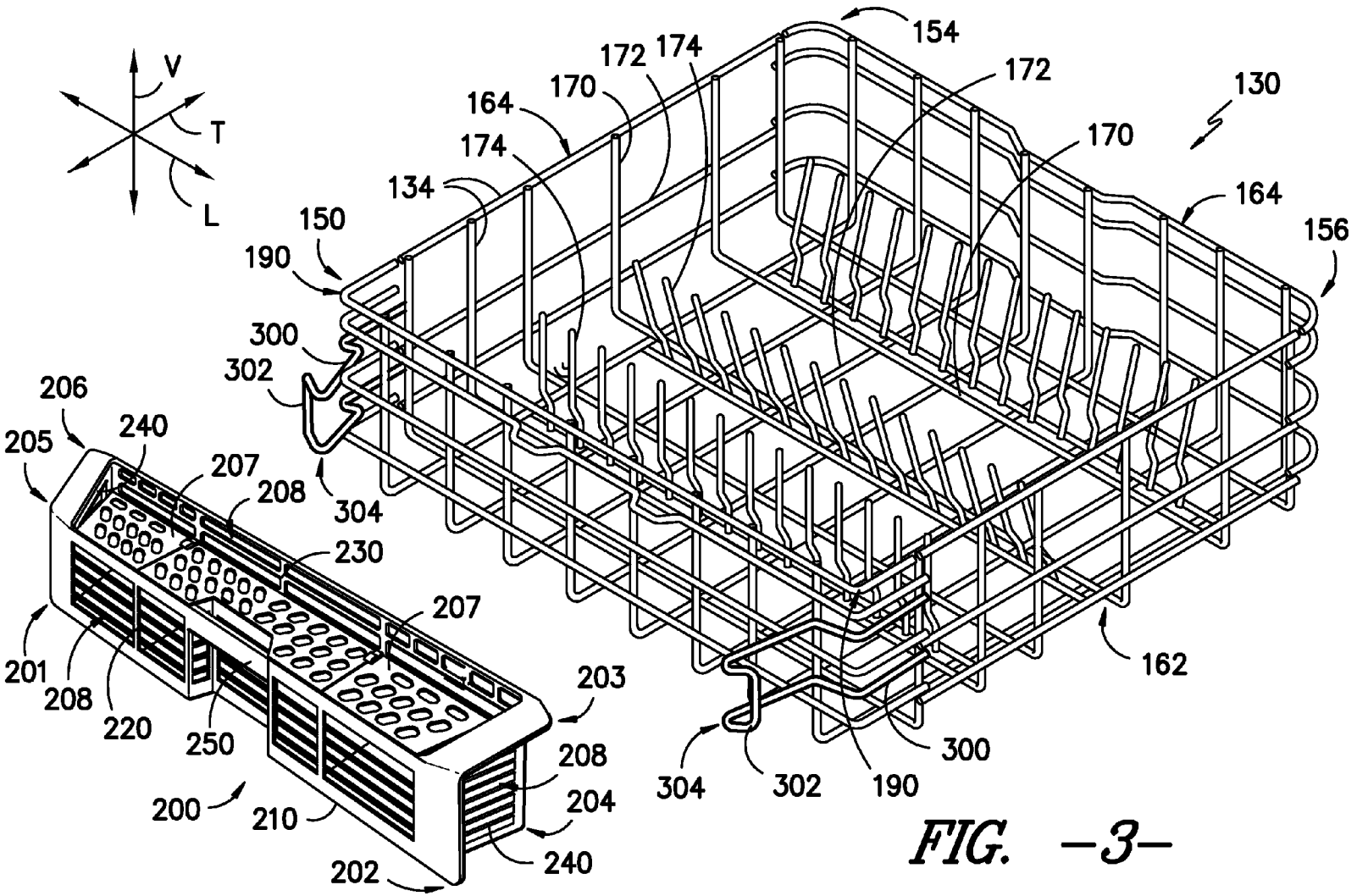
FIG. 3 illustrates a perspective view of an exemplary embodiment of a rack assembly and an exemplary embodiment of a silverware basket with the silverware basket shown removed from the rack assembly.
Figure 4:
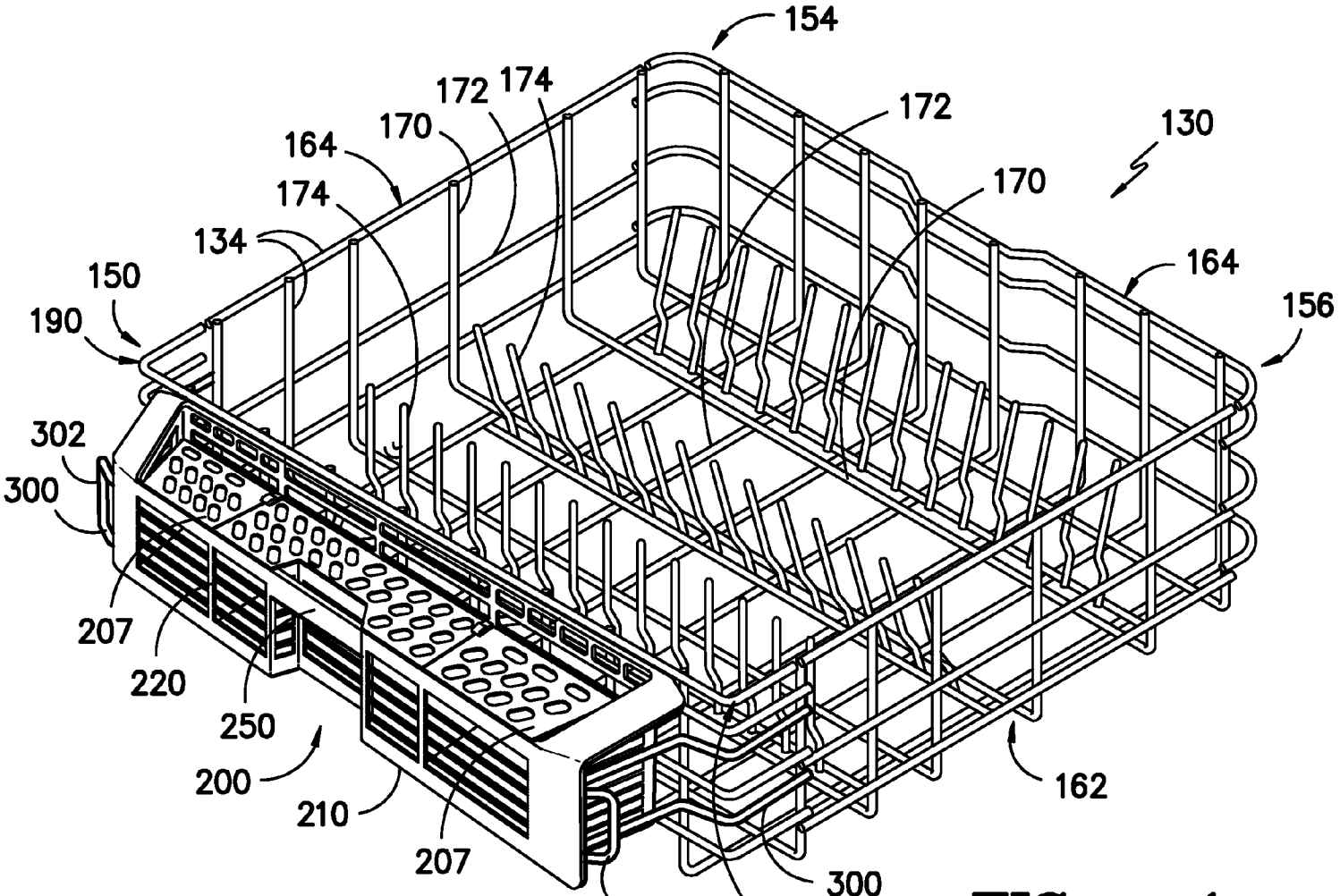
FIG. 4 illustrates a perspective view of the rack assembly and the silverware basket of FIG. 3 with the silverware basket shown mounted to the rack assembly.

FIG. 3 illustrates perspective view of upper rack assembly 130 and silverware basket 200 removed from dishwasher appliance 100. In FIG. 3, silverware basket 200 is detached and spaced apart from upper rack assembly 130. FIG. 4 illustrates a perspective view of upper rack assembly 130 and silverware basket 200 with silverware basket 200 mounted to rack assembly 130.

As may be seen in FIGS. 3 and 4, upper rack assembly 130 is generally configured as a basket-like structure having a bottom wall 162 and a front wall 150 and sidewalls 164 that extends upwardly from bottom wall 162 along the vertical direction V. Front wall 150 extends along the lateral direction L in order to extend between and connect sidewalls 164. Front wall 150 and sidewalls 164 form corners 190 where front wall 150 meets sidewalls 164.

As discussed above, upper rack assembly 130 is formed from plurality of elongated members 134. Thus, bottom wall 162, front wall 150, and sidewalls 164 may be formed with wire or rod members into an open lattice structure. For example, the bottom wall 162 may be defined by a plurality of longitudinal rods 172 that are crossed with a plurality of lateral rods 170, as generally known in the art. Rods 170, 172 may be connected together by any suitable means, including welding, epoxy, clips, and so forth. A plurality of fixed tines 174 project vertically upward from bottom wall 162 and from any combination of the rods 170, 172.

As shown in FIG. 3, silverware basket 200 extends between a first side 201 and a second side 202 along lateral direction L, e.g., when silverware basket 200 is mounted to upper rack assembly 130 as shown in FIG. 4. Silverware basket 200 further extends between a top 203 and a bottom 204 along a vertical direction V and between a front 205 and a back 206 along a transverse direction T, e.g., when silverware basket 200 is mounted to upper rack assembly 130 as shown in FIG. 4.

Silverware basket 200 includes a bottom panel 210. A front panel 220 extends from bottom panel 210 along the vertical direction V. Similarly, a back panel 230 extends from bottom panel 210 along the vertical direction V. Back panel 230 and front panel 220 are spaced apart along the transverse direction T. Silverware basket 200 also includes a pair of opposing side panels 240 mounted on first and second sides 201 and 202 of silverware basket 200 respectively. Side panels 240 arte spaced apart along the lateral direction L and extend between and connect front panel 220 and back panel 230 along the transverse direction T.

Bottom panel 210, front panel 220, back panel 230, and side panels 240 assist in defining a storage volume (not shown) configured for receipt of articles (e.g., forks, knives, spoons, and/or other utensils) for washing. Covers 207 are mounted to back panel 230 and provide for selective access to the storage volume of silverware basket 200. In FIGS. 3 and 4, covers 207 are shown in a closed position in which covers 207 hinder access to the storage volume. However, a user may rotate covers 207 to an open position to permit access to the storage volume, e.g., to add utensils to or remove utensils from the storage volume.

Bottom panel 210, front panel 220, back panel 230, and side panels 240 also define a plurality of holes 208. Plurality of holes 208 permits wash fluid to flow into and out of the storage volume of silverware basket 200, e.g., during operation of dishwasher appliance 100. Plurality of holes 208 also permits a flow of air through the storage volume, e.g., to assist in drying articles located therein.

As best seen in FIG. 3, projections 300 (or at least one projection 300) are mounted to upper rack assembly 130 at front wall 150 of upper rack assembly 130 (e.g., at corners 190). In particular, projections 300 extend away from front wall 150 of upper rack assembly 130 along the transverse direction T. Projections 300 are mounted on both a first side 154 of upper rack assembly 130 and a second side 156 of upper rack assembly 130. Thus, projections 300 are spaced apart along the lateral direction L on upper rack assembly 130.

Projections 300 include a handle 302 mounted at a distal end 304 of handle 300. As an example, a user may grasp handle 302 of projection 300 to slide upper rack assembly 130 out of wash chamber 106 when upper rack assembly 130 is in the retracted position shown in FIG. 2. Similarly, silverware basket 200 also includes a handle 250 that the user may grasp to slide upper rack assembly 130 out of wash chamber 106 when upper rack assembly 130 is in the retracted position shown in FIG. 2.

In the exemplary embodiment shown in FIGS. 3 and 4, projections 300 are constructed of metal wire. For example, projections 300 may be constructed from the same material as upper rack assembly 130 in order to provide a uniform cosmetic appearance to a user. However, in alternative exemplary embodiments, projections 300 may be constructed of any suitable material. For example, projections 300 may be constructed of plastic or a combination of metal wire and plastic. Projections 300 are discussed in greater detail below.

Figure 5:
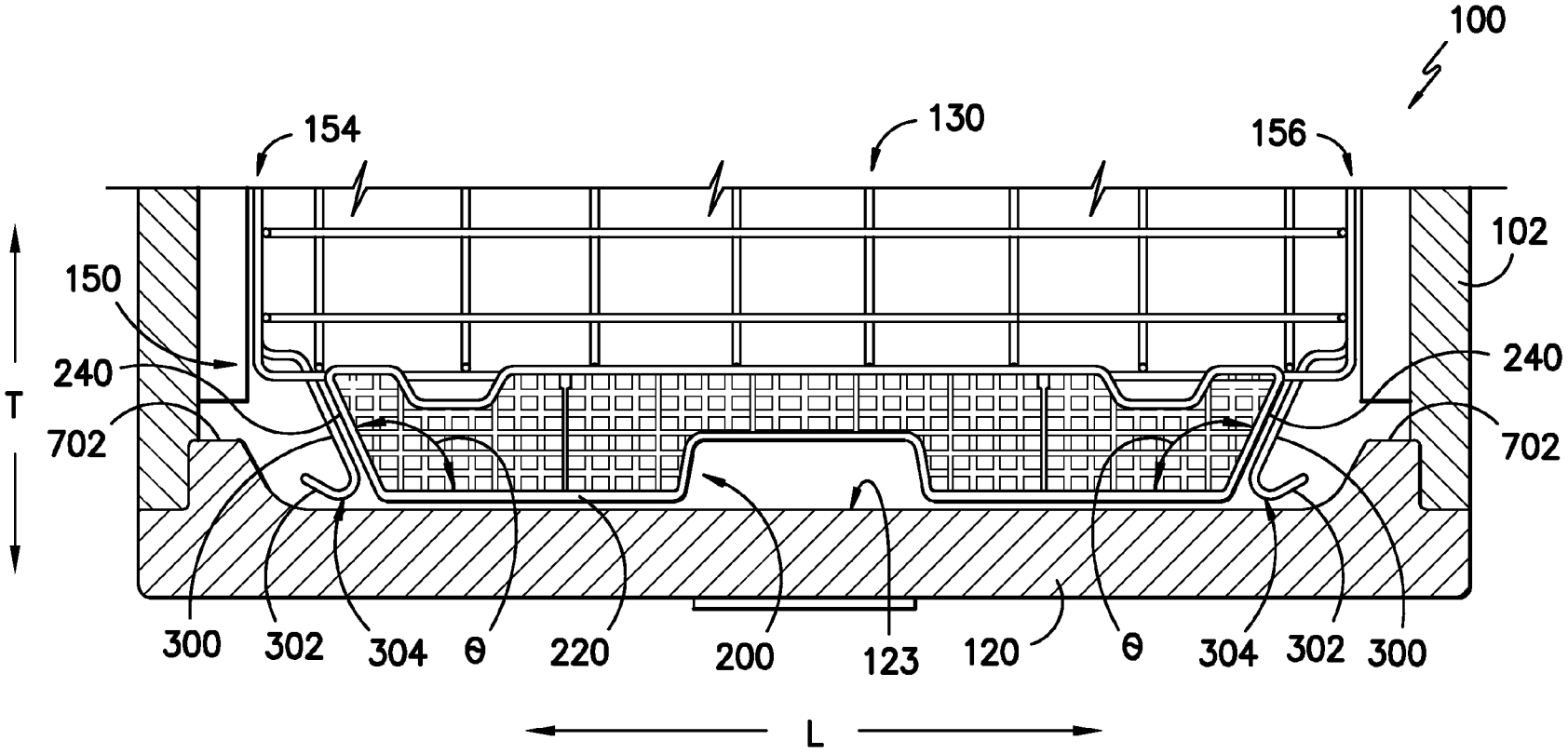
FIG. 5 is a top, partial cross-sectional view of the dishwasher appliance of FIG. 1 taken along the 5-5 line shown in FIG. 1.

FIG. 5 is a top, partial cross-sectional view of dishwasher appliance 100 taken along the 5-5 line shown in FIG. 1. As may be seen in FIG. 5, projections 300 are positioned immediately adjacent, e.g., positioned on, in close proximity to, or almost touching side panels 240 of silverware basket 200, when silverware basket 200 is mounted to upper rack assembly 130. In particular, because silverware basket 200 has an isosceles trapezoidal shape along the vertical direction V (FIG. 4), silverware basket 200 is wedged between projections 300 along the lateral direction L and transverse direction T. Thus, projections 300 hinder movement of silverware basket 200 along the lateral direction L when silverware basket 200 is mounted to upper rack assembly 130 because side panels 240 are positioned adjacent projections 300 and will impact projections 300 if silverware basket 200 is moved along the lateral direction L.

As may be seen in FIG. 5, front panel 220 of silverware basket 200 forms an angle θ with side panels 240 of silverware basket 200. In FIG. 5, angle θ is obtuse, e.g., about one-hundred and twenty degrees. However, in alternative embodiments, angle θ may be any suitable angle. For example, angle θ may be a right angle or may be acute. As a further example, angle 0 may be between about one-hundred and fifty degrees and about one-hundred and ten degrees, between about ninety degrees and about fifty degrees, or between about one-hundred and twenty degrees and about sixty degrees.

Projections 300 may also hinder movement of silverware basket 200 along the transverse direction T when silverware basket 200 is mounted to upper rack assembly 130 because side panels 240 are positioned adjacent projections 300 and will impact projections 300 if silverware basket 200 is moved along the transverse direction T. For example, when a user pulls on silverware basket 200, e.g., handle 250 (FIG. 3) of silverware basket 200, to slide upper rack assembly 130 out of wash chamber 106 (FIG. 2), projections 300 assist in preventing silverware basket 200 from rotating or pulling away from front wall 150 of upper rack assembly 130. Accordingly, projections 300 assist in securely mounting silverware basket 200 to upper rack assembly 130. Conversely, projections 300 permit movement of silverware basket 200 along the vertical direction V (FIG. 3), e.g., to permit removal of silverware basket 200 from upper rack assembly 130.

Further, as may be seen in FIG. 5, distal end 304 of projections 300 is spaced apart from interior surface 123 of door 120. As an example, distal end 304 of projections 300 may be spaced apart from interior surface 123 of door 120 by between about one eighth of an inch and about one quarter of an inch when door 120 is in the closed position and rack assembly 130 is in the retracted position. However, in alternative exemplary embodiments, distal end 304 of projections 300 may be spaced apart from interior surface 123 of door 120 by any suitable distance when door 120 is in the closed position and rack assembly 130 is in the retracted position, e.g., between about one sixteenth of an inch and about one half of an inch or between about one sixteenth of an inch and about three eighths of an inch. Such spacing between distal end 304 of projections 300 and interior surface 123 of door 120 can assist in properly positioning upper rack assembly 130 in the retracted position as described in greater detail below.

FIGS. 6 and 7 are side, partial cross-sectional views of dishwasher appliance 100. In FIG. 6, silverware basket 200 is mounted to upper rack assembly 130. Conversely, silverware basket 200 is removed from upper rack assembly 130 in FIG. 7.

As may be seen in FIG. 6, silverware basket 200 has a thickness $t_{sb}$ along the transverse direction T, e.g., between front panel 220 and back panel 230 of silverware basket 200. Projections 300 extend away from front wall 150 of upper rack assembly 130 by about the thickness $t_{sb}$ of silverware basket 200. By extending away from front wall 150 of upper rack assembly 130 in such a manner, projections 300 can assist in properly positioning upper rack assembly 130 within wash chamber 106 of tub 104.

For example, as shown in FIG. 6, silverware basket 200 can engage door 120 when door 120 shifts to the closed position from the open position. In particular, front panel 220 of silverware basket 200 can engage interior surface 123 of door 120 when door 120 shifts to the closed position from the open position. As door 120 shifts to the closed position, door 120 impacts silverware basket 200 that is mounted to upper rack assembly 130 and urges or slides upper rack assembly 130 into the retracted position within wash chamber 106 if upper rack assembly 130 is not already positioned in the retracted position. Thus, silverware basket 200 can assist in properly positioning rack assembly 130 in the retracted position. Projections 300 perform a similar function when silverware basket 200 is not mounted to upper rack assembly 130 as shown in FIG. 7.

As may be seen in FIG. 7, projections 300 extend away from front wall 150 of upper rack assembly 130 by about the thickness $t_{sb}$ of silverware basket 200. Thus, in a similar manner to silverware basket 200 described above, projections 300 (e.g., distal end 304 of projections 300) engage door 120 when door 120 is in the closed position to properly position upper rack assembly 130 in the retracted position when silverware basket 200 is not mounted to rack assembly 130.

Properly positioning upper rack assembly 130 in the retracted position can be important for proper operation of dishwasher appliance 100. As discussed above and as may be seen in FIGS. 6 and 7, mid-level spray assembly 148 is mounted to upper rack assembly 130. However, when upper rack assembly 130 is positioned in the extended position or otherwise out of the retracted position, mid-level spray assembly 148 is inoperable because it cannot receive fluid from the fluid circulation system described above.

In particular, the fluid circulation system includes a nozzle 180 mounted to a back wall 184 of tub 104. Nozzle 180 receives wash fluid, e.g., from a pump of the fluid circulation assembly. Nozzle 180 directs such wash fluid into an inlet 182 of mid-level spray assembly 148 when upper rack assembly 130 is in the retracted position. Thus, as will be understood by those skilled in the art, nozzle 180 engages within inlet 182 when upper rack assembly 130 is in the retracted position. However, nozzle 182 may be incapable of delivering wash fluid to inlet 182 when upper rack assembly 130 is positioned in the extended position or otherwise out of the retracted position.

As discussed above, projections 300 assist in properly positioning upper rack assembly 130 in the retracted position when door 120 is in the closed position. Thus, projections 300 can assist engagement of nozzle 180 with inlet 182 of mid-level spray assembly 148 to insure proper operation of mid-level spray assembly 148. In particular, projections 300 can assist engagement of nozzle 180 with inlet 182 of mid-level spray assembly 148 despite the location of silverware basket 200, i.e., whether silverware basket 200 is mounted to upper rack assembly 130 or not.

FIGS. 8-11 illustrate various additional exemplary embodiments of a projection 400, 500, 600, and 700 mounted to the upper rack assembly 130. The various exemplary embodiments of projection 400, 500, 600, and 700 shown in FIGS. 8-11 respectively are substantially similar to projections 300 (FIG. 3). However, each projection 400, 500, 600, and 700 includes various modifications. For example, in FIG. 8, projection 400 does not include a handle on a distal end of the projection 400. In FIG. 9, silverware basket 200 defines a hole 502 through which distal end 501 of projection 500 extends to engage door 120 (FIG. 2) when door 120 is in the closed position even when silverware basket 200 is mounted to upper rack assembly 200. In FIG. 10, projection 600 extends past silverware basket 200 to engage door 120 (FIG. 2) when door 120 is in the closed position even when silverware basket 200 is mounted to upper rack assembly 200. In FIG. 11, a distal end 701 of projection 700 is configured to engage a flange 702 (FIG. 5) of door 120 when door 120 is in the closed position rather than interior surface 123 of door 120. Flange 702 of door 120 is disposed at an edge of door 120 and is spaced apart from interior surface 123 of door 120 along the transverse direction T as may be seen in FIG. 5.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance defining vertical, lateral, and transverse directions, the vertical, lateral, and transverse directions being mutually perpendicular, the dishwasher appliance comprising:

a tub defining a wash chamber;

a door mounted proximate said tub and permitting selective access to the wash chamber of said tub;

a rack assembly mounted within the wash chamber of said tub and configured for receipt of articles for cleaning, said rack assembly having a front wall extending along the lateral direction;

a silverware basket removably mounted to the front wall of said rack assembly such that said silverware basket is disposed between the front wall of said rack assembly and said door along the transverse direction when said door is in a closed position; and at least one projection positioned at the front wall of said rack assembly and extending away from the front wall of said rack assembly along the transverse direction to about said door when said door is in the closed position and said rack assembly is in a retracted position within the wash chamber of said tub wherein, said at least one projection positions said rack assembly in the retracted position when said door is in the closed position.

2. The dishwasher appliance of claim 1, wherein said silverware basket has a thickness in the transverse direction, said at least one projection extending away from the front wall of said rack assembly along the transverse direction by about the thickness of said silverware basket.

3. The dishwasher appliance of claim 1, wherein said at least one projection comprises a pair of projections, wherein said rack assembly extends between a first side and a second side along the lateral direction, wherein projections of said pair of projections are positioned on the first side of said rack assembly and on the second side of said rack assembly.

4. The dishwasher appliance of claim 3, wherein said silverware basket comprises a first side panel spaced apart from a second side panel along the lateral direction, wherein projections of said pair of projections are positioned immediately adjacent the first side panel and the second side panel of said silverware basket.

5. The dishwasher appliance of claim 4, wherein said silverware basket further comprises a front panel that extends between and connects the first side panel and the second side panel, wherein said front panel forms an angle θ with each of the first side panel and the second side panel, wherein the angle θ is obtuse.

6. The dishwasher appliance of claim 1, wherein said at least one projection has a distal end positioned away from the front wall of said rack assembly, wherein the distal end of said at least one projection is spaced apart from an interior surface of said door by between about one eighth of an inch and about one quarter of an inch when said door is in the closed position and said rack assembly is in the retracted position.

7. The dishwasher appliance of claim 1, further comprising:

a nozzle for directing a flow of liquid into the wash chamber of said tub, said nozzle mounted at a back wall of said tub; and a spray assembly mounted at a bottom of said rack assembly, said spray assembly defining an inlet configured for engagement with said nozzle when said rack assembly is in a retracted position.

8. The dishwasher appliance of claim 1, wherein said at least one projection has a distal end positioned away from the front wall of said rack assembly, wherein said at least one projection comprises a handle positioned on the distal end of said projection.

9. The dishwasher appliance of claim 1, wherein said at least one projection and said rack assembly are at least partially constructed of metal wire.

10. The dishwasher appliance of claim 1, wherein said rack assembly further comprises a sidewall that extends from the front wall of said rack assembly along the transverse direction, the front wall and the sidewall forming a corner where the front wall meets the sidewall, said at least one projection positioned at the corner.

11. A dishwasher appliance defining vertical, lateral, and transverse directions, the vertical, lateral, and transverse directions being mutually perpendicular, the dishwasher appliance comprising:

a tub defining a wash chamber;

a door positioned proximate said tub and permitting selective access to the wash chamber of said tub;

a rack assembly positioned within the wash chamber of said tub and configured for receipt of articles for cleaning, said rack assembly having a front wall extending along the lateral direction;

a silverware basket removably mounted at the front wall of said rack assembly such that said silverware basket is disposed between the front wall of said rack assembly and said door along the transverse direction when said door is in a closed position, said silverware basket having a thickness along the transverse direction;

at least one projection positioned at the front wall of said rack assembly and extending away from the front wall of said rack assembly along the transverse direction by about the thickness of said silverware basket wherein, said at least one projection positions said rack assembly in the retracted position when said door is in the closed position.

12. The dishwasher appliance of claim 11, wherein said at least one projection comprises a pair of projections, wherein said rack assembly extends between a first side and a second side along the lateral direction, wherein projections of said pair of projections are positioned on the first side of said rack assembly and on the second side of said rack assembly.

13. The dishwasher appliance of claim 12, wherein said silverware basket comprises a first side panel spaced apart from a second side panel along the lateral direction, wherein projections of said pair of projections are positioned immediately adjacent the first side panel and the second side panel of said silverware basket.

14. The dishwasher appliance of claim 13, wherein said silverware basket further comprises a front panel that extends between and connects the first side panel and the second side panel of said silverware basket, wherein said front panel forms an angle θ with each of the first side panel and the second side panel, wherein the angle θ is obtuse.

15. The dishwasher appliance of claim 11, further comprising:

a nozzle for directing a flow of liquid into the wash chamber of said tub, said nozzle mounted at a back wall of said tub; and a spray assembly mounted at a bottom wall of said rack assembly, said spray assembly defining an inlet configured for engagement with said nozzle when said rack assembly is in a retracted position.

16. The dishwasher appliance of claim 11, wherein said at least one projection has a distal end positioned away from the front wall of said rack assembly, wherein the distal end of said at least one projection is spaced apart from an interior surface of said door by between about one eighth of an inch and about one quarter of an inch when said door is in the closed position and said rack assembly is in the retracted position.

17. The dishwasher appliance of claim 11, wherein said at least one projection has a distal end positioned away from the front wall of said rack assembly, wherein said at least one projection comprises a handle positioned on the distal end of said projection.

18. The dishwasher appliance of claim 11, wherein said at least one projection and said rack assembly are at least partially constructed of metal wire.

19. The dishwasher appliance of claim 11, wherein said rack assembly further comprises a sidewall that extends from the front wall of said rack assembly along the transverse direction, the front wall and the sidewall forming a corner where the front wall meets the sidewall, said at least one projection positioned at the corner.

* * * * *